US009476623B2

(12) United States Patent
Tsukino

(10) Patent No.: US 9,476,623 B2
(45) Date of Patent: Oct. 25, 2016

(54) MULTIPLE-UNIT AIR CONDITIONING APPARATUS

(71) Applicant: Hideki Tsukino, Tokyo (JP)

(72) Inventor: Hideki Tsukino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 743 days.

(21) Appl. No.: 13/763,759

(22) Filed: Feb. 11, 2013

(65) Prior Publication Data

US 2013/0227981 A1 Sep. 5, 2013

(30) Foreign Application Priority Data

Mar. 1, 2012 (JP) ..... 2012-045535

(51) Int. Cl.
*F25B 49/02* (2006.01)
*F25B 13/00* (2006.01)
*F25B 49/00* (2006.01)

(52) U.S. Cl.
CPC ..... *F25B 49/02* (2013.01); *F25B 13/00* (2013.01); *F25B 49/005* (2013.01); *F25B 2313/0233* (2013.01); *F25B 2313/02741* (2013.01); *F25B 2313/0314* (2013.01)

(58) Field of Classification Search
CPC ..... F25B 49/02; F25B 49/005; F25B 2313/0233; F25B 2313/0314; F25B 2313/0231; F25B 2313/02321; F25B 27/1352; F25B 27/135; F25B 2700/1352; F25B 2700/135; F24F 11/006; F24F 2011/0052
USPC ..... 62/125, 126, 127, 129; 700/276, 277
See application file for complete search history.

(56) References Cited

U.S. PATENT DOCUMENTS 6,210,119 B1 * 4/2001 Lifson ..... F04C 28/28 417/18
2004/0123624 A1 * 7/2004 Ohta ..... B60H 1/323 62/498

(Continued)

FOREIGN PATENT DOCUMENTS

EP 1 746 364 A2 1/2007
EP 2 180 271 A1 4/2010

(Continued)

OTHER PUBLICATIONS

Machine Translation, JP 2007-218512, Japan Platform for Patent Information.*

(Continued)

*Primary Examiner* — Mohammad M Ali
(74) *Attorney, Agent, or Firm* — Posz Law Group, PLC

(57) ABSTRACT

To obtain a multiple-unit air conditioning apparatus capable of detecting, when improper wire connections are made, improper wiring and eliminating an improper wiring state without performing a re-wiring work. When an operation command for an indoor unit Y, received from indoor unit control means 15, does not match a refrigerant circuit of an indoor unit Y whose refrigerant circulation is controlled by outdoor unit control means 14, operation patterns are extracted on the basis of the number of operating indoor units Y. A refrigerant circuit in which a refrigerant is circulated is switched in accordance with the operation patterns. Each wire 18 connected to the indoor unit control means 15 of each indoor unit Y is associated with each refrigerant circuit controlled by the outdoor unit control means 14, and recognition of wire connections is changed.

10 Claims, 7 Drawing Sheets

(56) References Cited

U.S. PATENT DOCUMENTS

| | | | | |
|---|---|---|---|---|
| 2006/0123810 | A1* | 6/2006 | Ha | F24F 11/0012 62/149 |
| 2009/0025420 | A1* | 1/2009 | Kojima | F24F 1/0059 62/527 |
| 2009/0302124 | A1* | 12/2009 | Dawson | F24F 7/10 236/49.3 |
| 2010/0174412 | A1* | 7/2010 | Kwon | F24F 11/0009 700/275 |

FOREIGN PATENT DOCUMENTS

| | | | |
|---|---|---|---|
| JP | 2001-289480 | A | 10/2001 |
| JP | 2005-282903 | A | 10/2005 |
| JP | 2007-218512 | A | 8/2007 |

OTHER PUBLICATIONS

Office Action issued on Nov. 21, 2013 in the corresponding Australian patent application No. 2013200726.

Office Action dated Feb. 28, 2015 issued in corresponding CN patent application No. 2013100661796 (and English translation).

Office Action mailed Apr. 21, 2015 issued in corresponding JP patent application No. 2012-045535 (and English translation).

Extended European Search Report issued on May 24, 2013 in the corresponding EP patent application No. 13155622.7-1602.

* cited by examiner

MULTIPLE-UNIT AIR CONDITIONING APPARATUS

DESCRIPTION

1. Technical Field

The present invention relates to a multiple-unit air conditioning apparatus including an outdoor unit and multiple indoor units.

2. Background Art

A multiple-unit air conditioning apparatus is capable of connecting multiple indoor units to one outdoor unit, and hence, is capable of performing multiple-room air conditioning even in a condominium with a limited space for installing the apparatus. Because of its space-saving and high-exterior features and cost advantages, more and more multiple-unit air conditioning apparatuses are used in recent years.

However, because multiple indoor units are connected to one outdoor unit in the multiple-unit air conditioning apparatus, after the indoor units are respectively connected by pipes to the outdoor unit and then refrigerant circuits are formed, when the indoor units are respectively connected to corresponding connection ports of the outdoor unit, the indoor units may be connected to wrong connection ports corresponding to other indoor units. Because of these so-called improper wire connections, a command from an indoor unit recognized by the outdoor unit does not properly correspond to a refrigerant circuit to be controlled. Thus, the outdoor unit performs control to cause a refrigerant to flow not to an indoor unit operated by a user, but to a different indoor unit with an improper wire connection, resulting in the problem that desired operation is not performed.

As a multiple-unit air conditioning apparatus of the related art, for example, one that "includes diagnostic operation setting means for setting a diagnostic operation mode, and storage means for storing whether the diagnostic operation has been performed, wherein, at the time operation in a normal operation mode starts, the details stored in the storage means are checked and, when the diagnostic operation has not been performed yet, diagnostic operation is started" is proposed (for example, see Japanese Unexamined Patent Application Publication No. 2005-282903 (claim 1).

As another example, one that "changes, when the operation control information for the indoor unit, received from the indoor unit control means, does not match the refrigerant circuit of the indoor unit whose refrigerant circulation is controlled by the outdoor unit control means, association between each wire connected to the indoor unit control means and each refrigerant circuit controlled by the outdoor unit control means, and causes the operation control information for the indoor unit, received from the indoor unit control means, to match the refrigerant circuit of the indoor unit whose refrigerant circulation is controlled by the outdoor unit control means" is proposed (for example, see Japanese Unexamined Patent Application Publication No. 2007-218512 (claim 2).

SUMMARY OF INVENTION

Technical Problem

In the air conditioning apparatus discussed in Japanese Unexamined Patent Application Publication No. 2005-282903 (claim 1), diagnostic operation is performed at the time the normal operation mode is performed for the first time. Thus, a normal test operation would be always performed if diagnostic operation is forgotten at the time the apparatus is installed. On this assumption, forgetting to perform diagnostic operation upon completion of installing the apparatus can be prevented. Further, when an abnormality is determined in diagnostic operation, it is displayed on a display unit that there is an abnormality. However, such diagnostic operation may not be performed in an actual case. In that case, after the apparatus is handed over to a user, diagnostic operation would be performed for the first time when the first normal operation is performed. If an abnormality is detected at that time, a technician must again test and re-install the apparatus at a later date.

In the air conditioning apparatus discussed in Japanese Unexamined Patent Application Publication No. 2007-218512 (claim 2), when the outdoor unit control means determines that an operating indoor unit is abnormal, improperly wired indoor units are detected by sequentially interchanging recognition with other deactivated indoor units, and the interchanged recognition is stored. Since this method detects a pair of improperly wired units and make corrections one by one, it may be necessary to perform diagnostic operation multiple times to correct all the improperly wired units. When a pair of indoor units with improper wire connections is simultaneously operating, these improper wire connections are not detected. These improper wire connections would be corrected the next time the diagnostic operation is performed.

To solve the above-mentioned problems, the present invention provides a multiple-unit air conditioning apparatus capable of detecting improper wiring when improper wire connections are made and correcting an improper wiring state without performing a re-wiring work.

Solution to Problem

A multiple-unit air conditioning apparatus according to the present invention includes an outdoor unit and multiple indoor units. A compressor, indoor heat exchangers provided for the individual indoor units, expansion devices that are provided for the individual indoor heat exchangers and that change refrigerant flow rate, and an outdoor heat exchanger provided for the outdoor unit are connected by refrigerant pipes, and refrigerant circuits in which a refrigerant is circulated are formed for the individual indoor units. Each of the indoor units includes indoor unit control means for controlling operation of the indoor unit and transmitting an operation command for the indoor unit and measurement information of the indoor unit. The outdoor unit includes outdoor unit control means connected by wires to the indoor unit control means of the individual indoor units. The outdoor unit control means receives an operation command for each of the indoor units, transmitted by the indoor unit control means of the indoor unit, and recognizes that an indoor unit corresponding to a wire that has received the operation command is operating, and performs control to circulate the refrigerant in a refrigerant circuit corresponding to the operating indoor unit. When the operation command for the indoor unit, received from the indoor unit control means, does not match the refrigerant circuit of the indoor unit whose refrigerant circulation is controlled by the outdoor unit control means, the outdoor unit control means extracts operation patterns of a refrigerant circuit in which the refrigerant is circulated and a refrigerant circuit in which no refrigerant is circulated, on the basis of the number of operating indoor units; switches the refrigerant circuit in which the refrigerant is circulated, in accordance with each of the operation patterns; associates each wire connected to the indoor unit control means of each indoor unit and each refrigerant circuit controlled by the outdoor unit control means, on the basis of the measurement information of the indoor unit, received from the indoor unit control means, and an operation state of the indoor unit corresponding to the wire which has received the measurement information; and changes recognition of the wire connections so that the operation command for the indoor unit, received from the indoor unit control means, matches the refrigerant circuit of the indoor unit whose refrigerant circulation is controlled by the outdoor unit control means.

Advantageous Effects of Invention

The present invention extracts, on the basis of the number of operating indoor units, operation patterns of a refrigerant circuit in which a refrigerant is circulated and a refrigerant circuit in which no refrigerant is circulated. In accordance with each of the operation patterns, the refrigerant circuit in which the refrigerant is circulated is switched. On the basis of measurement information of each indoor unit, received from the indoor unit control means, and the operation state of an indoor unit corresponding to a wire that has received the measurement information, each wire connected to the indoor unit control means of each indoor unit is associated with each refrigerant circuit controlled by the outdoor unit control means, thereby changing the recognition of wire connections. Therefore, improper wire connections can be eliminated without changing the wire connections. When there are multiple improper wire connections, even if multiple indoor units are operating, the improper wire connections can be eliminated by performing one diagnostic operation, without changing the wire connections.

Since a re-wiring work is unnecessary, even if the apparatus in a state where improper wire connections have been made at the time of installation is handed over to a user, the apparatus can perform, as it is in that state, normal operation desired by the user.

DETAILED DESCRIPTION

Embodiment 1

Figure 1:
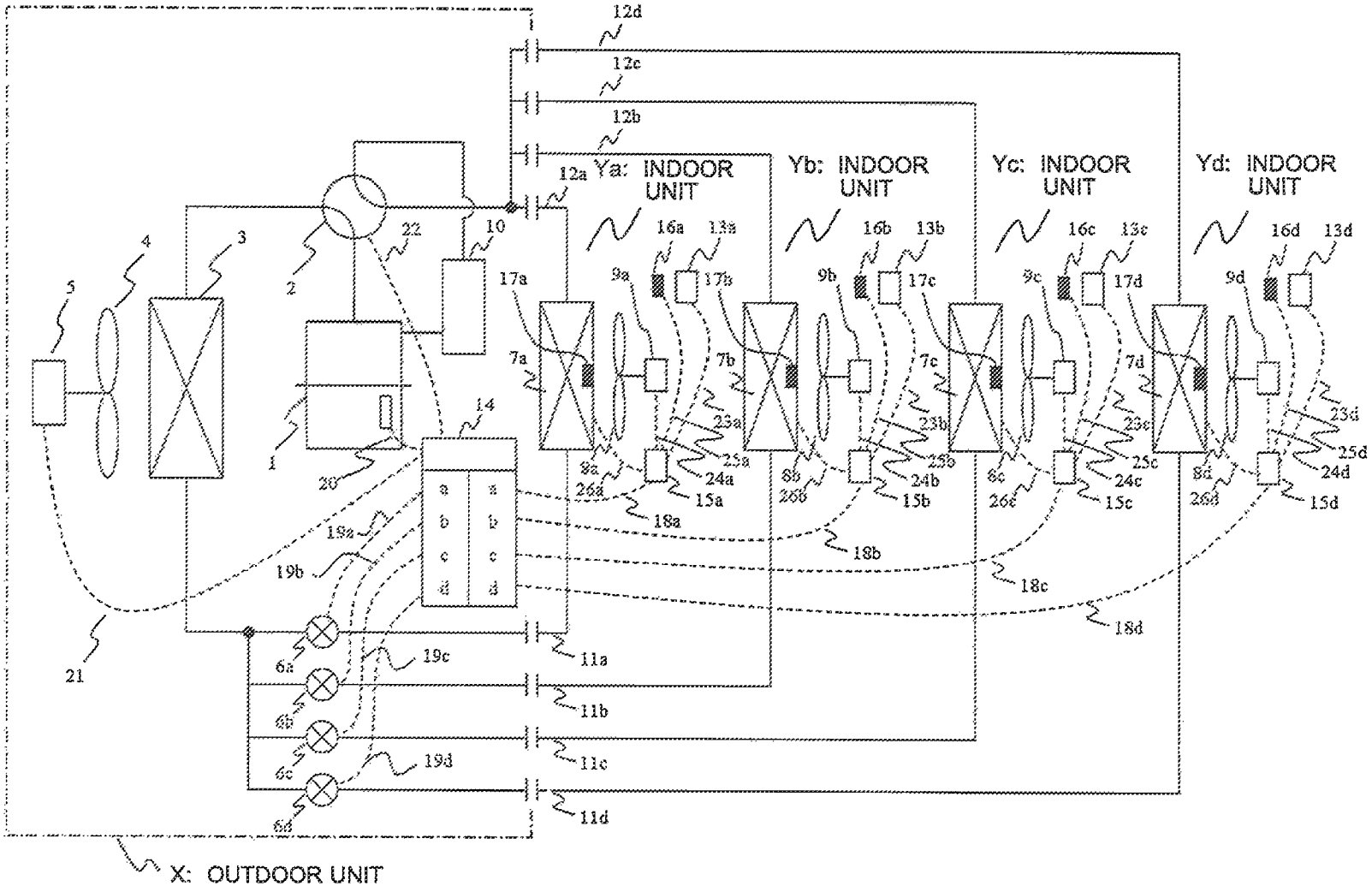
FIG. 1 is a diagram of a multiple-unit air conditioning apparatus according to Embodiment 1 of the present invention.

FIG. 1 is a diagram of a multiple-unit air conditioning apparatus according to Embodiment 1 of the present invention. In FIG. 1, the multiple-unit air conditioning apparatus according to Embodiment 1 of the present invention includes a compressor 1 that compresses a refrigerant, a four-way valve 2 that switches the flow direction of the refrigerant, an outdoor heat exchanger 3 that is a heat exchanger for performing heat exchange between outdoor air and the refrigerant, an outdoor fan 4 that is an air-sending device for sending air to the outdoor heat exchanger 3, an outdoor fan motor 5 that rotates and drives the outdoor fan 4, expansion valves 6*a* to 6*d* (expansion devices) that change the flow rate of the refrigerant and reduces the pressure of the refrigerant, indoor heat exchangers 7*a* to 7*d* that are heat exchangers for performing heat exchange between indoor air and the refrigerant, indoor fans 8*a* to 8*d* that are air-sending devices for sending air to the indoor heat exchangers 7*a* to 7*d*, indoor fan motors 9*a* to 9*d* that rotate and drive the indoor fans 8*a* to 8*d*, a liquid pool 10 that accommodates the refrigerant at the time of operation, liquid pipes 11*a* to 11*d* and gas pipes 12*a* to 12*d* that are refrigerant pipes, remote controls 13*a* to 13*d* that input operations of indoor units, outdoor unit control means 14 that controls an outdoor unit, indoor unit control means 15*a* to 15*d* that control the indoor units, indoor inlet air temperature detecting means 16*a* to 16*d* that detect the temperature of air sent by the indoor fans 8*a* to 8*d*, and indoor heat exchanger temperature detecting means 17*a* to 17*d* that detect pipe temperatures T17*a* to T17*d* of the indoor heat exchangers 7*a* to 7*d*. Also, multiple indoor units Y are installed, and these multiple units Y are respectively connected to an outdoor unit X by the liquid pipes 11*a* to 11*d* and the gas pipes 12*a* to 12*d*, thereby configuring refrigerant circuits in which refrigerants are circulated. Here, for example, it is assumed that there are four indoor units. Note that a lower-case alphabet character after a reference numeral indicates the name of an indoor unit.

Further, the outdoor unit X and the individual indoor units Y include wires 18*a* to 18*d* that connect the outdoor unit control means 14 and the indoor unit control means 15*a* to 15*d*, wires 19*a* to 19*d* that connect the expansion valves 6*a* to 6*d* and the outdoor unit control means 14, a wire 20 that connects the compressor 1 and the outdoor unit control means 14, a wire 21 that connects the outdoor fan motor 5 and the outdoor unit control means 14, a wire 22 that connects the four-way valve 2 and the outdoor unit control means 14, wires 23*a* to 23*d* that connect the remote controls 13*a* to 13*d* and the indoor unit control means 15*a* to 15*d*, wires 24*a* to 24*d* that connect the indoor fan motors 9*a* to 9*d* and the indoor unit control means 15*a* to 15*d*, wires 25*a* to 25*d* that connect the indoor inlet air temperature detecting means 16*a* to 16*d* and the indoor unit control means 15*a* to 15*d*, and wires 26*a* to 26*d* that connect the indoor heat exchanger temperature detecting means 17*a* to 17*d* and the indoor unit control means 15*a* to 15*d*. Instead of the wires 23*a* to 23*d* which connect the remote controls 13*a* to 13*d* and the indoor unit control means 15*a* to 15*d*, signals may be wirelessly communicated.

Next, the operation in the case where cooling operation or heating operation is performed with the above-mentioned configuration will be described.

In the multiple-unit air conditioning apparatus with the above-mentioned configuration, the cooling operation in which two out of the four connected indoor units perform cooling operation will be described by using the case in which indoor units Ya and Yb operate. The expansion valves 6*a* and 6*b* are opened at a certain opening degree, and the expansion valves 6*c* and 6*d* are completely closed. A high-pressure and high-temperature gas refrigerant discharged from the compressor 1 flows via the four-way valve 2 into the outdoor heat exchanger 3 to which air is sent by the outdoor fan 4. The gas refrigerant is heat-exchanged, in the outdoor heat exchanger 3, with the ambient air and is condensed, and, as a result, a high-pressure liquid refrigerant flows. The flowing high-pressure liquid refrigerant is branched into the expansion valves 6*a* and 6*b*, and the pressure of the liquid refrigerant is reduced to become a low-pressure two-phase gas liquid refrigerant, which flows via the liquid pipes 11*a* and 11*b* into the indoor heat exchangers 7*a* and 7*b* to which air is forcedly sent by the indoor fans 8*a* and 8*b*. The gas liquid refrigerant is heat-exchanged, in the indoor heat exchangers 7*a* and 7*b*, with the ambient air and is evaporated, and, as a result, a low-pressure gas refrigerant flows. The flowing low-pressure gas refrigerant is branched into the gas pipes 12*a* and 12*b* and then merged together, which returns to the compressor 1 via the four-way valve 2 and the liquid pool 10. Note that the indoor fans 8*c* and 8*d* of the deactivated indoor units Yc and Yd are in a deactivated state.

The refrigerant operation at the time the heating operation is performed will be described by using the case in which the indoor units Ya and Yb operate. The expansion valves 6*a* and 6*b* are opened at a certain opening degree, and the expansion valves 6*c* and 6*d* are opened at an opening degree set to be smaller than the opening degree of the expansion valves 6*a* and 6*b* corresponding to the operating indoor units Ya and Yb. A high-pressure and high-temperature gas refrigerant discharged from the compressor 1 is branched via the four-way valve 2 and flows into the indoor heat exchangers 7*a* and 7*b* to which air is forcedly sent by the indoor fans 8*a* and 8*b* via the gas pipes 12*a* and 12*b*. The gas refrigerant is heat-exchanged, in the indoor heat exchangers 7*a* and 7*b*, with the ambient air and is condensed, and, as a result, a high-pressure liquid refrigerant flows. The flowing high-pressure liquid refrigerant flows into the expansion valves 6*a* and 6*b* via the liquid pipes 11*a* and 11*b*, and the pressure of the liquid refrigerant is reduced to become a low-pressure two-phase gas liquid refrigerant, which is merged together and flows into the outdoor heat exchanger 3. The gas liquid refrigerant is heat-exchanged, in the outdoor heat exchanger 3, with the ambient air and is evaporated, and, as a result, a low-pressure gas refrigerant flows. The flowing low-pressure gas refrigerant returns to the compressor 1 via the four-way valve 2 and the liquid pool 10. Note that the indoor fans 8*c* and 8*d* of the deactivated indoor units Yc and Yd are in a deactivated state.

Hereinafter, the operation of automatic correction of improper wire connections of wires will be described.

Figure 2:
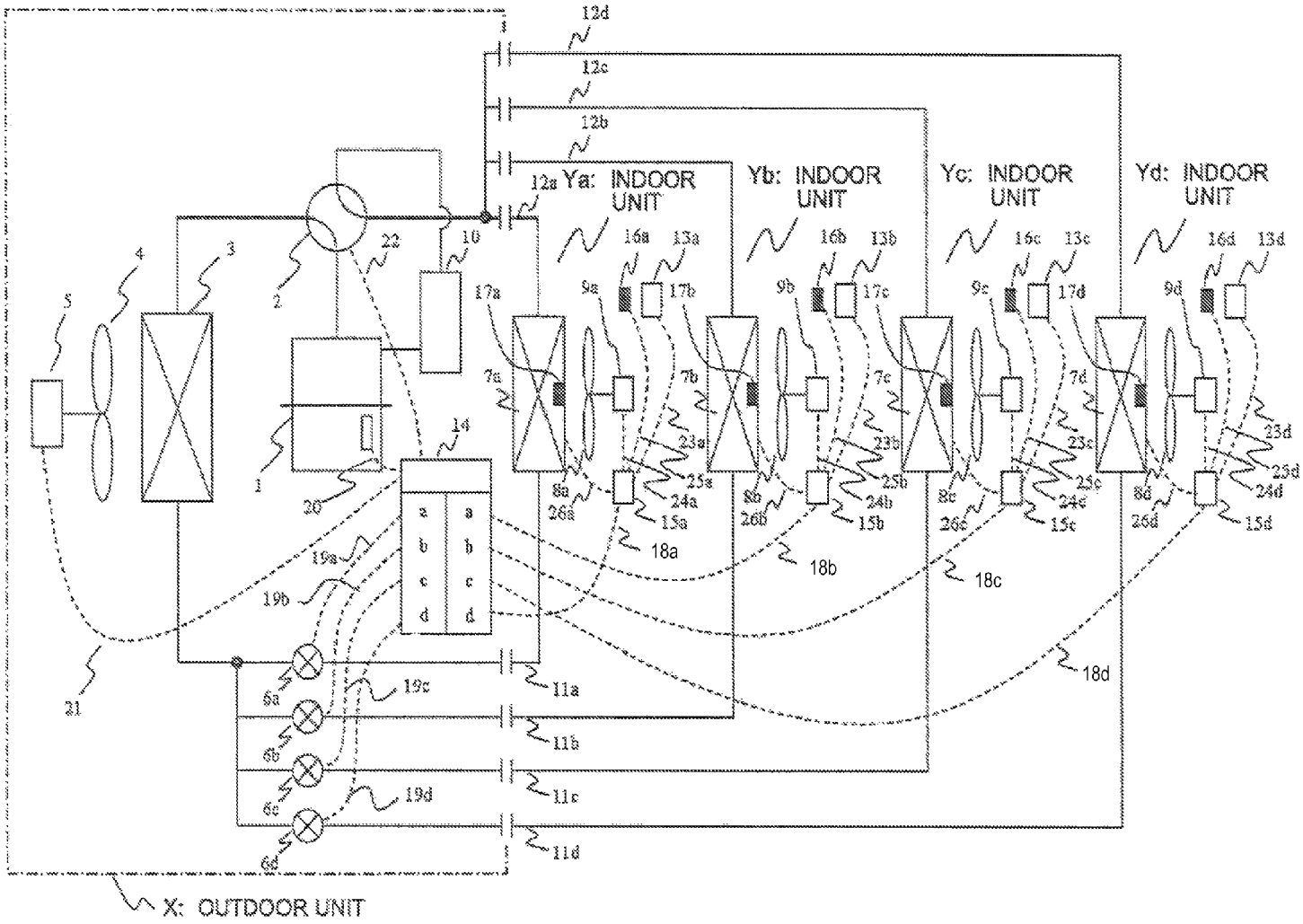
FIG. 2 is a diagram illustrating an example of refrigerant circuits with improper wire connections that are made at the time the apparatus is installed according to Embodiment 1 of the present invention.
Figure 3:
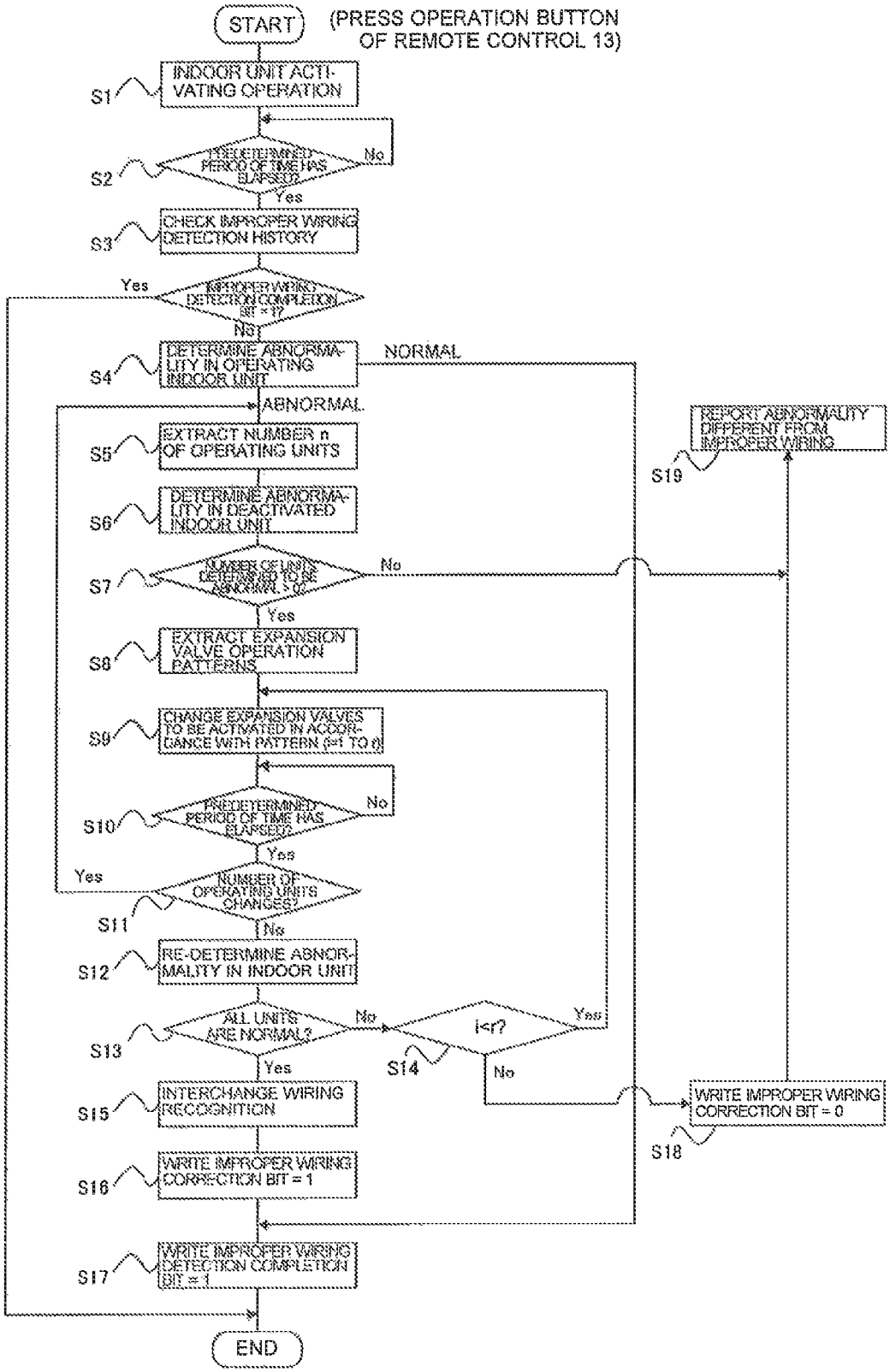
FIG. 3 is a flowchart illustrating abnormality detection control steps according to Embodiment 1 of the present invention.

FIG. 2 is a diagram illustrating an example of refrigerant circuits with improper wire connections that are made at the time the multiple-unit air conditioning apparatus is installed according to Embodiment 1 of the present invention. FIG. 3 is a flowchart illustrating abnormality detection control steps according to Embodiment 1 of the present invention. FIGS. 4 to 8 are flowcharts illustrating detailed steps of abnormality detection control.

Hereinafter, the operation in the normal case (FIG. 1) in which there is no improper wire connection in wires between the outdoor unit control means 14 of the outdoor unit)(and the indoor unit control means 15*i* of the individual indoor units Yi (i indicates the name of each indoor unit), and the operation of correcting improper wire connections in the case (FIG. 2) in which improper wire connections are made will be described.

(Normal Wiring Case)

Figure 4:
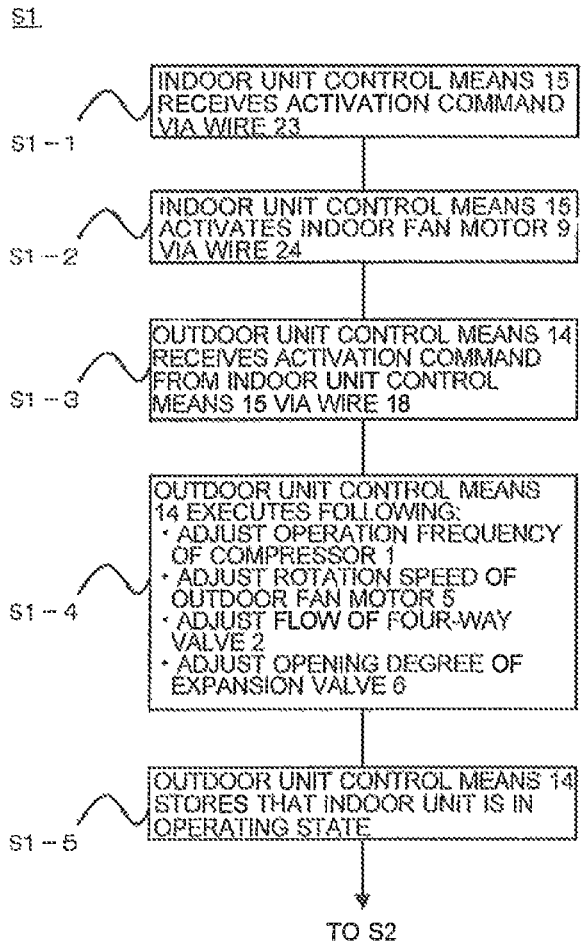
FIG. 4 is a flowchart illustrating detailed steps of abnormality detection control S1.

FIG. 1 illustrates normal wire connections. Here, control steps at the time the indoor unit Ya is activated will be described with reference to FIG. 3. When the remote control 13*a* of the indoor unit Ya selects a cooling operation mode and performs an activation operation, the indoor unit control means 15*a* of the indoor unit Ya starts an indoor unit activating operation (S1). FIG. 4 illustrates detailed steps of step S1. When an operation button of the remote control 13*a* is pressed, the indoor unit control means 15*a* receives a cooling operation command via the wire 23*a* (S1-1). Note that the wire 23*a* may be wired or wireless. The indoor unit control means 15*a* activates the indoor fan motor 9*a* via the wire 24*a* at a certain rotation speed (S1-2). The indoor unit control means 15*a* transmits an operation command to the outdoor unit control means 14 via the wire 18*a* and reports that the indoor unit Ya has started a cooling operation (S1-3). The outdoor unit control means 14 receives the operation command, recognizes that the indoor unit Ya has started a cooling operation, adjusts the operation frequency of the compressor 1, the rotation speed of the outdoor fan motor 5, and the passage of the four-way valve 2 to be in an appropriate state, and opens the expansion valve 6*a* at a certain opening degree (S1-4). The outdoor unit control means 14 stores that the indoor unit Ya is in an operating state (S1-5).

Next, it is determined whether a certain period of time has elapsed (S2). When a certain period of, for example, five minutes has elapsed, it is checked whether improper wiring detection control has been previously performed for an indoor unit stored by the outdoor unit control means 14 to be in an operating state (hereinafter referred to as an "operating indoor unit") (S3). This is checked in order to prevent re-application of improper wiring detection control to an indoor unit that has already been subjected to improper wiring detection control, and to promptly proceed to normal operation. In S3, when "1" is detected in an improper wiring detection completion bit of the operating indoor unit Ya in a volatile memory of the outdoor unit control means 14, normal operation is performed without any additional operation. When "1" is not detected in the improper wiring detection completion bit, abnormality determination of the operating indoor unit Ya is performed (S4).

Figure 5:
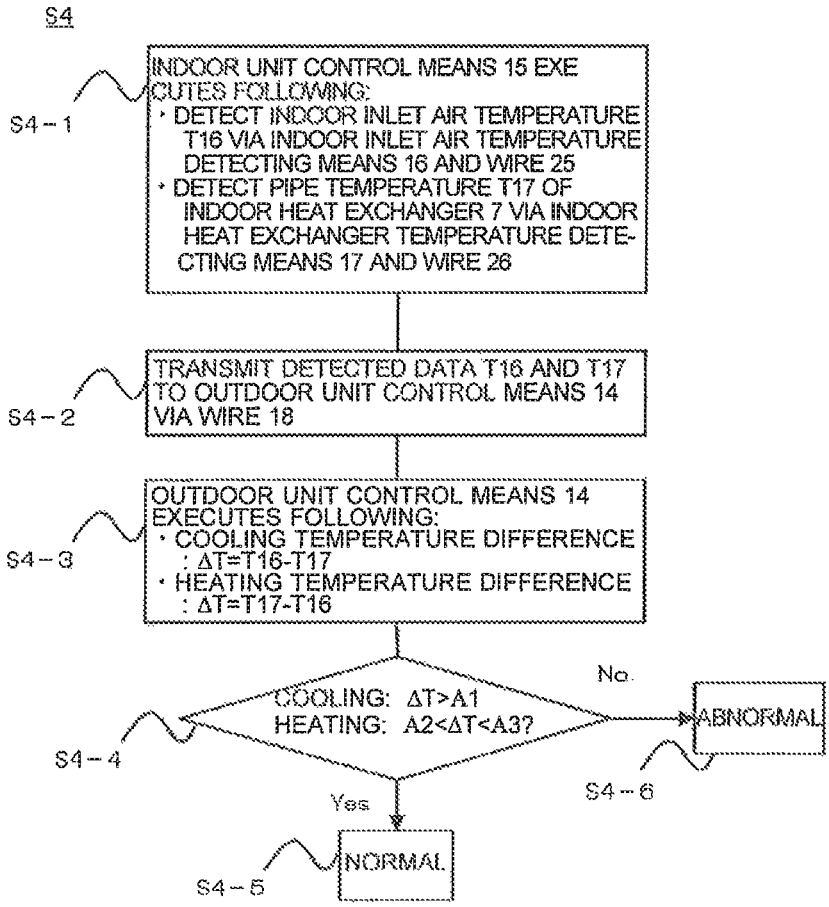
FIG. 5 is a flowchart illustrating detailed steps of abnormality detection control S4.

Here, FIG. 5 illustrates detailed steps of the abnormality determination of the operating indoor unit Ya (S4). Using the indoor inlet air temperature detecting means 16*a*, the indoor unit control means 15*a* detects the indoor inlet air temperature T16*a* serving as measurement information via the wire 25*a*, and, using the indoor heat exchanger temperature detecting means 17*a*, the indoor unit control means 15*a* detects the pipe temperature T17*a* of the indoor heat exchanger 7*a*, serving as measurement information, via the wire 26*a* (S4-1). The indoor unit control means 15*a* transmits temperature data (measurement information) of the detected indoor inlet air temperature T16*a* and the detected pipe temperature T17*a* of the indoor heat exchanger 7*a* to the outdoor unit control means 14 via the wire 18*a* (S4-2). The outdoor unit control means 14 calculates a temperature difference ΔTa between the pieces of temperature data of the received indoor inlet air temperature T16*a* and the received pipe temperature T17*a* of the indoor heat exchanger 7*a*.

A calculating equation in the cooling operation is ΔTa=T16*a*-T17*a* (S4-3), The calculated temperature difference ΔTa is compared with a certain value α1 within a first certain range (S4-4). When the calculated temperature difference ΔTa is greater than the certain value α1, such as 7 deg, it is determined that the operation is normal (S4-5).

When the calculated temperature difference ΔTa is not greater than the certain value α1, it is determined that the operation is abnormal (S4-6).

Also, a calculating equation in the heating operation is ΔTa=T17*a*-T16*a* (S4-4). It is checked whether the calculated temperature difference ΔTa is within certain values α2 and α3. When this condition is satisfied, it is determined that the operation is normal (S4-5). When this condition is not satisfied, it is determined that the operation is abnormal (S4-6). Here, the certain value α2 is, for example, 10 deg, and the certain value α3 is, for example, 20 deg.

Here, in the above-mentioned case, because the wires are normally connected, the expansion valve 6*a* communicated with the indoor heat exchanger 7*a* is open at a certain opening degree. A refrigerant flows into the indoor heat exchanger 7*a* to which air is sent by the indoor fan 8*a*, and the refrigerant is heat-exchanged and evaporated. The pipe temperature T17*a* of the indoor heat exchanger 7*a* is reduced to be less than the indoor inlet air temperature T16*a* by a certain temperature or greater, and the temperature difference ΔTa becomes greater than the certain value α1. Therefore, it is determined that the operation is normal in step S4-4, and the abnormality detection control is terminated.

(Improper Wiring Case 1)

As illustrated in FIG. 2, a technician makes wiring mistakes and connects one of two ends of the wire 18*a* to the indoor unit control means 15*a* of the indoor unit Ya and erroneously connects the other end to a connection port for the indoor unit Yd of the outdoor unit control means 14; the technician connects one of two ends of the wire 18*b* to the indoor unit control means 15*b* of the indoor unit Yb and erroneously connects the other end to a connection port for the indoor unit Ya of the outdoor unit control means 14; the technician connects one of two ends of the wire 18*c* to the indoor unit control means 15*c* of the indoor unit Yc and erroneously connects the other end to a connection port for the indoor unit Yb of the outdoor unit control means 14; and the technician connects one of two ends of the wire 18*d* to the indoor unit control means 15*d* of the indoor unit Yd and erroneously connects the other end to a connection port for the indoor unit Yc of the outdoor unit control means 14.

Control steps at the time the indoor unit Ya is activated in this state will be described with reference to FIG. 3.

When the remote control 13*a* of the indoor unit Ya selects a cooling mode and performs an activation operation, the indoor unit control means 15*a* of the indoor unit Ya starts an indoor unit activating operation (S1). FIG. 4 illustrates detailed steps of step S1. When an operation button of the remote control 13*a* is pressed, the indoor unit control means 15*a* receives a cooling operation command via the wire 23*a* (S1-1). The indoor unit control means 15*a* activates the indoor fan motor 9*a* via the wire 24*a* at a certain rotation speed (S1-2). The indoor unit control means 15*a* transmits an operation command to the outdoor unit control means 14 via the wire 18*a* and reports that the indoor unit Ya has started a cooling operation (S1-3). Since the wire 18*a* is connected, due to an improper wire connection, to the connection port for the indoor unit Yd of the outdoor unit control means 14, the outdoor unit control means 14 recognizes that the indoor unit Yd has started operating, adjusts the operation frequency of the compressor 1, the rotation speed of the outdoor fan motor 5, and the passage of the four-way valve 2 to be in an appropriate state, and opens the expansion valve 6*d* at a certain opening degree while keeping the expansion valve 6*a* completely closed (S1-4). The outdoor unit control means 14 stores that the indoor unit Yd is in an operating state (S1-5).

Next, it is determined whether a certain period of time has elapsed (S2). When a certain period of, for example, five minutes has elapsed, it is checked whether improper wiring detection control has been previously performed for an operating indoor unit stored by the outdoor unit control means 14 to be in an operating state (S3). When "1" is detected in the improper wiring detection completion bit of the operating indoor unit Yd in a volatile memory of the outdoor unit control means 14, normal operation is performed without any additional operation. When "1" is not detected in the improper wiring detection completion bit, abnormality determination of the operating indoor unit Yd, recognized by the outdoor unit control means 14 to be in an operating state, is performed (S4). Since the wire 18*a* is connected to the wire connection port for the indoor unit Yd of the outdoor unit control means 14, the indoor inlet air temperature T16*a* of the indoor unit Ya and the pipe temperature T17*a* of the indoor heat exchanger 7*a*, which are detected in step S4-1, are transmitted to the outdoor unit control means 14 (S4-2). From these two pieces of temperature data, the outdoor unit control means 14 calculates the temperature difference ΔTd=T16*a*-T17*a* (S4-3).

At this time, because the expansion valve 6*a* communicated with the indoor heat exchanger 7*a* to which air is sent by the indoor fan 8*a* is completely closed, no refrigerant flows into the indoor heat exchanger 7*a*. Thus, the refrigerant retained in the indoor heat exchanger 7*a* is quickly evaporated, and the pipe temperature T17*a* of the indoor heat exchanger 7*a* becomes substantially equal to the indoor inlet air temperature T16*a*. Thus, the temperature difference ΔTd becomes a value less than the certain value α1 (such as 7 deg), and it is determined that the operation is abnormal in step S4-4. At this time, the outdoor unit control means 14 stores that the indoor unit Yd as an abnormal y operating indoor unit.

Figure 6:
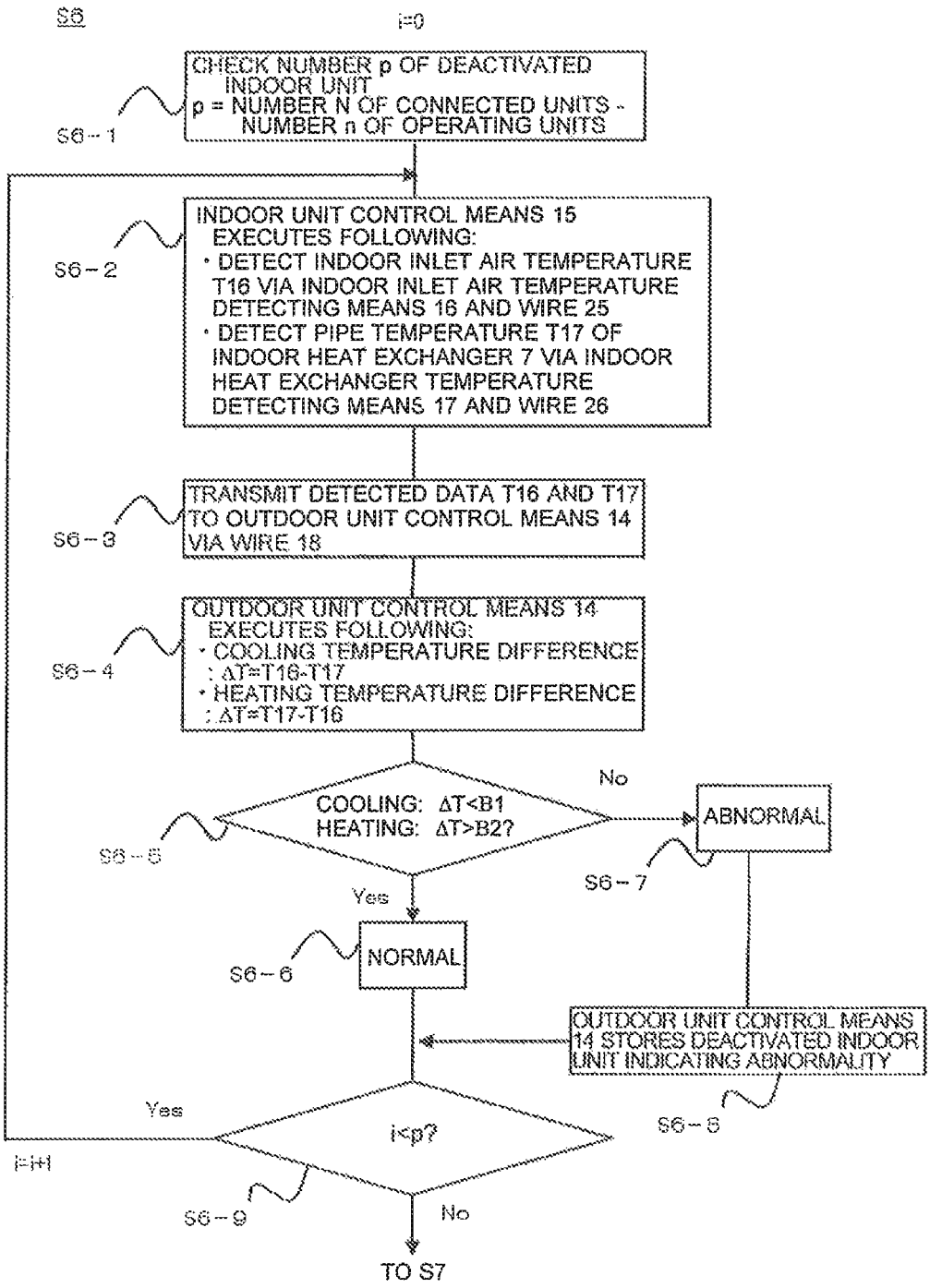
FIG. 6 is a flowchart illustrating detailed steps of abnormality detection control S6.

Next, the outdoor unit control means 14 extracts the number of operating indoor units (S5) and performs abnormality determination of all the indoor units (Ya, Yb, and Yc) recognized by the outdoor unit control means 14 to be in a deactivated state (hereinafter referred to as "deactivated indoor units) (S6). FIG. 6 illustrates detailed steps of step S6, Firstly, the outdoor unit control means 14 extracts deactivated indoor units (Ya, Yb, and Yc) and the number (p=3) of deactivated indoor units (S6-1), and performs abnormality determination of the individual deactivated indoor units.

Using the indoor inlet air temperature detecting means 16*i* (i indicates the name of each indoor unit), the indoor unit control means 15*i* of each deactivated indoor unit detects the indoor inlet air temperature T16*i* via the wire 25*i*, and, using the indoor heat exchanger temperature detecting means 17*i*, detects the pipe temperature T17*i* of the indoor heat exchanger 7*i* via the wire 26*i* (S6-2). The indoor unit control means 15*i* transmits the detected temperature data T16*i* and T17*i* to the outdoor unit control means 14 via the wire 18*i* (S6-3), The outdoor unit control means 14 calculates the difference ΔTi between the received two pieces of temperature data.

A calculating equation in the cooling operation is ΔTi=T16*i*-T17*i* (S6-4). The calculated temperature difference ΔTi is compared with a certain value β1 within a second certain range (S6-5). When the calculated temperature difference ΔT*i* is less than the certain value β1, it is determined that the operation is normal (S6-6). When the calculated temperature difference ΔT*i* is not less than the certain value β1, it is determined that the operation is abnormal (S6-7).

A calculating equation in the heating operation is ΔTi=T17*i*-T16*i* (S6-4). The calculated temperature difference ΔTi is compared with a certain value β2 within the second certain range (S6-5). When the calculated temperature difference ΔTi is greater than the certain value β2, it is determined that the operation is normal (S6-6). When the calculated temperature difference ΔTi is not greater than the certain value β2, it is determined that the operation is abnormal (S6-7). Here, the certain value β1 is, for example, 3.5 deg, and the certain value β2 is, for example, 20 deg. When the operation is abnormal, the outdoor unit control means 14 stores the abnormal indoor unit (S6-8).

As described above, steps S6-2 to S6-8 are performed for all the deactivated indoor units (S6-9), Here, since the wire 18*d* is connected, due to an improper wire connection, to the connection port for the indoor unit Yc of the outdoor unit control means 14, the indoor inlet air temperature T16*d* of the indoor unit Yd and the pipe temperature T17*d* of the indoor heat exchanger 7*d* are transmitted to the outdoor unit control means 14, and the temperature difference ΔTc is calculated from these pieces of temperature data. The expansion valve 6*d* communicated with the indoor heat exchanger 7*d* for which the indoor fan 8*d* is operating is open at a certain opening degree, and the temperature of the refrigerant flowing through the indoor heat exchanger 7*d* is greatly reduced. Thus, the temperature difference ΔTc becomes a value greater than the certain value β1, and it is determined that the operation is abnormal in step S6-5. The indoor unit Yc is stored as an abnormal indoor unit.

Similarly, the temperature difference ΔTa is calculated on the basis of he temperature data of the indoor unit Yb connected to the wire connection port for the indoor unit Ya of the outdoor unit control means 14, and the temperature difference ΔTb is calculated on the basis of the temperature data of the indoor unit Yc connected to the wire connection port for the indoor unit Yb of the outdoor unit control means 14. In this case, the temperature difference ΔTa is calculated from the indoor inlet air temperature T16*b* of the indoor unit Yb and the pipe temperature T17*b* of the indoor heat exchanger 7*b*. Since the expansion valve 6*b* communicated with the indoor heat exchanger 7*b* for which the indoor fan 8*b* is deactivated is completely closed, no refrigerant flows. Thus, ΔTa becomes a value less than the certain value β1, and it is determined that the operation is normal in step S6-5. Also, the temperature difference ΔTb is calculated from the indoor inlet air temperature T16*c* of the indoor unit Yc and the pipe temperature T17*c* of the indoor heat exchanger 7*c*. Since the expansion valve 6*c* communicated with the indoor heat exchanger 7*c* for which the indoor fan 8*c* is deactivated is completely closed, no refrigerant flows. Thus, ΔTb becomes a value less than the certain value β1 (for example, 3.5 deg), and it is determined that the operation is normal in step S6-5.

Next, the outdoor unit control means 14 determines whether there is one or more indoor units determined to be abnormal among the deactivated indoor units (S7). When there is one or more abnormal deactivated indoor units, the outdoor unit control means 14 performs expansion valve operation pattern extraction (S8). When it is determined that there is no abnormal deactivated indoor unit, the outdoor unit control means 14 reports that there is an abnormality different from improper wiring on, for example, an LED of a control board of the outdoor unit or on a display board of a remote control (S19), and terminates the abnormality detection control.

Figure 7:
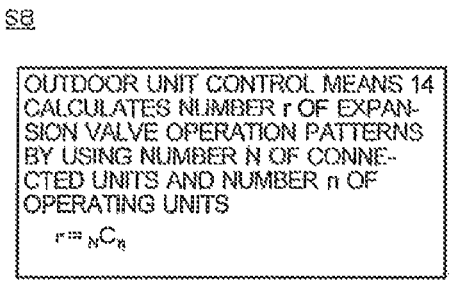
FIG. 7 is a flowchart illustrating detailed steps of abnormality detection control S8.

FIG. 7 illustrates detailed steps of step S8. The outdoor unit control means 14 extracts the number N of connected units, which is the number of all the indoor units connected by wires to the outdoor unit control means 14, and, by using the number N of connected units and the number n of operating units, calculates combinations of expansion valve operation patterns and the number of operation patterns. That is, the outdoor unit control means 14 obtains an expansion valve operation pattern that causes the refrigerant to circulate through refrigerant circuits, the number of which is the same as the number n of operating units, and that causes the refrigerant not to circulate through the other refrigerant circuits. This operation pattern can be obtained from combinations (non-overlapping combinations) of selecting the number of the number n of operating units in which the number N of connected units serves as an element, and the number r of combinations is $r={}_NC_n$.

In accordance with the expansion valve operation patterns extracted in step S8, the outdoor unit control means 14 interchanges the operation of the expansion valves 6 (S9). After a certain period of time has elapsed (S10), the outdoor unit control means 14 determines whether the number of operating units changes (S11). When there is no change, the outdoor unit control means 14 performs abnormality re-determination of all the indoor units (S12). When the number of operating units is changed, the outdoor unit control means 14 returns to step S5.

Figure 8:
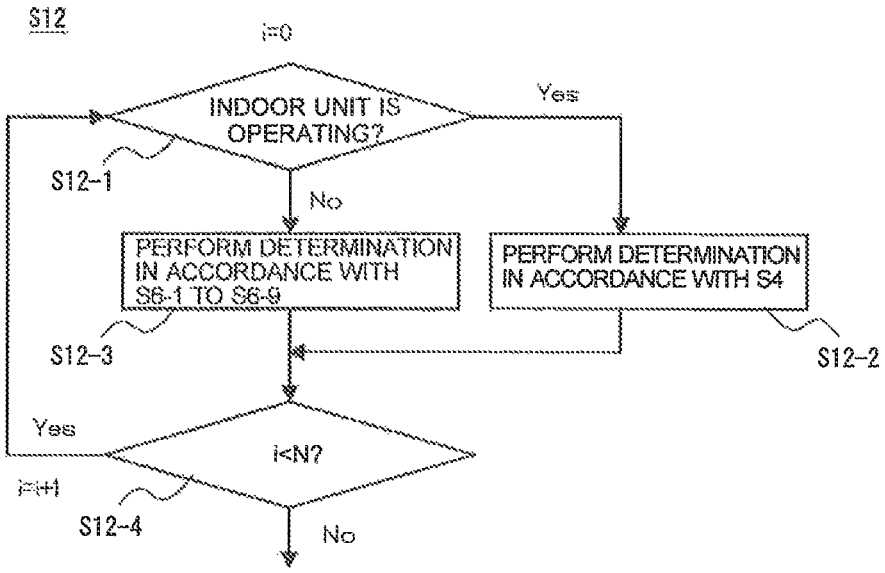
FIG. 8 is a flowchart illustrating detailed steps of abnormality detection control S12.

FIG. 8 illustrates detailed steps of step S12. The outdoor unit control means 14 determines whether an indoor unit serving as a target of abnormality re-determination is an indoor unit recognized as being operating (S12-1). When the indoor unit is an operating indoor unit, the outdoor unit control means 14 performs abnormality determination in accordance with step S4 described above (S12-2). When the indoor unit is a deactivated indoor unit, the outdoor unit control means 14 performs abnormality determination in accordance with steps S6-1 to S6-9 described above (S12-3). The outdoor unit control means 14 performs this abnormality re-determination of all the indoor units (S12-4).

With the above-mentioned abnormality re-determination, in estate in which the expansion valves 6 are switched in accordance with each of the operation patterns, it is determined whether the temperature difference ΔTd of the indoor unit Yd recognized by the outdoor unit control means 14 to be operating is greater than the certain value α1 and whether the temperature difference ΔTa of the indoor unit Ya, the temperature difference ΔTb of the indoor unit Yb, and the temperature difference ΔTc of the indoor unit Yc, which are recognized by the outdoor unit control means 14 to be deactivated, are less than the certain value β1.

Here, it is switched to an operation pattern in which the expansion valve 6*d*, which is open at a certain opening degree, is completely closed, and the expansion valve 6*c* is opened at a certain opening degree. Accordingly, the refrigerant flows into the indoor unit Yc. At this time, the temperature difference ΔTd of the operating indoor unit Yd is calculated by using the indoor inlet air temperature T16*a* of the indoor unit Ya and the pipe temperature T17*a* of the indoor heat exchanger 7*a* in accordance with ΔTd=T16*a*-T17*a*. Since the expansion valve 6*a* remains completely closed, ΔTd becomes a value less than the certain value α1, and the condition is not satisfied. The outdoor unit control means 14 stores that the operating indoor unit Yd abnormally corresponds to the expansion valve 6*c*.

Also, the temperature difference ΔTa of the deactivated indoor unit Ya, the temperature difference ΔTb of the deactivated indoor unit Yb, and the temperature difference ΔTc of the deactivated indoor unit Yc are calculated in accordance with ΔTa=T16*b*-T17*b*, ΔTb=T16*c*-T17*c*, and ΔTc=T16*d*-T17*d*, respectively. Here, ΔTa and ΔTc become values less than the certain value β1, and the condition is satisfied; however, ΔTb becomes a value greater than the certain value β1, and the condition is not satisfied.

These results indicate that it is highly likely that an indoor unit connected to the wire connection port for the indoor unit Yb of the outdoor unit control means 14 and the expansion valve 6*c* for controlling a refrigerant circuit that corresponds to the aforementioned indoor unit constitute a normal combination. Thus, the outdoor unit control means 14 stores that the deactivated indoor units Ya and Yc abnormally correspond to the expansion valve 6*c*, and the deactivated indoor unit Yb normally corresponds to the expansion valve 6*c*.

The outdoor unit control means 14 determines whether the results of the abnormality re-determination indicate that all the indoor units are normal (S13). When not all the indoor units are normal, the outdoor unit control means 14 determines whether abnormality re-determination is performed for all the expansion valve operation patterns extracted in step S8 (S14). When abnormality re-determination is not performed for all the operation patterns, the outdoor unit control means 14 returns to step S9. When it is determined that none of the indoor units are normal and when abnormality re-determination is performed for all the operation patterns, the outdoor unit control means 14 writes "0" to an improper wiring correction bit (S18), and reports that there is an abnormality different from improper wiring on, for example, an LED of a control board of the outdoor unit or on a display board of a remote control (S19).

As a next operation pattern, the expansion valve 6*c* is completely closed, and the expansion valve 6*b* is opened at a certain opening degree. Accordingly, the refrigerant flows into the indoor unit Yb. The temperature difference ΔTd of the operating indoor unit, calculated in accordance with ΔTd=T16*a*-T17*a*, becomes a value less than the certain value α1, and the condition is not satisfied. The outdoor unit control means 14 stores that the operating indoor unit Yd abnormally corresponds to the expansion valve 6*b*.

With regard to the temperature differences ΔTa. ΔTb, and ΔTc of the deactivated indoor units Ya, Yb, and Yc, which are calculated in accordance with ΔTa=T16*b*-T17*b*, ΔTb=T16*c*-T17*c*, and ΔTc=T16*d*-T17*d*, respectively, ΔTb and ΔTc become values less than the certain value β1, and the condition is satisfied; however, ΔTa becomes a value greater than the certain value β1, and the condition is not satisfied.

These results indicate that it is highly likely that an indoor unit connected to the wire connection port for the indoor unit Ya of the outdoor unit control means 14 and the expansion valve 6*b* for controlling a refrigerant circuit that corresponds to the aforementioned indoor unit constitute a normal combination. Thus, the outdoor unit control means 14 stores that the deactivated indoor units Yb and Yc abnormally correspond to the expansion valve 6*b*, and the deactivated indoor unit Ya normally corresponds to the expansion valve 6*b*.

Finally, the expansion valve 6*b* is completely closed, and the expansion valve 6*a* is opened at a certain opening degree. Accordingly, the refrigerant flows into the indoor unit Ya. The temperature difference ΔTd of the operating indoor unit, calculated in accordance with ΔTd=T16*a*-T17*a*, becomes a value greater than the certain value α1 and the condition is satisfied. The outdoor unit control means 14 stores that the operating indoor unit Yd normally corresponds to the expansion valve 6*a*. Also, with regard to the temperature differences ΔTa, ΔTb, and ΔTc of the deactivated indoor units Ya, Yb, and Yc, which are calculated in accordance with ΔTa=T16*b*-T17*b*, ΔTb=T16*c*-T17*c*, and ΔTc=T16*d*-T17*d*, respectively, ΔTa, ΔTb, and ΔTc all become values less than the certain value β1, and the condition is satisfied. From these results, the outdoor unit control means 14 stores that the deactivated indoor units Ya, Yb, and Yc abnormally correspond to the expansion valve 6*a*.

From the above description, it is understood that the operating indoor unit Yd matches the expansion valve 6*a* for controlling a refrigerant circuit that corresponds to the operating indoor unit Yd, and, at the same time, it is understood that the deactivated indoor unit Ya matches the expansion valve 6*b* for controlling a refrigerant circuit that corresponds to the deactivated indoor unit Ya; the deactivated indoor unit Yb matches the expansion valve 6*c* for controlling a refrigerant circuit that corresponds to the deactivated indoor unit Yb; and the deactivated indoor unit Yc matches the expansion valve 6*d* for controlling a refrigerant circuit that corresponds to the deactivated indoor unit Yc. In short, it is understood that the indoor unit Yb is erroneously connected to the connection port for the indoor unit Ya of the outdoor unit control means 14, the indoor unit Yc is erroneously connected to the connection port for the indoor unit Yb of the outdoor unit control means 14, the indoor unit Yd is erroneously connected to the connection port for the indoor unit Yc of the outdoor unit control means 14, and the indoor unit Ya is erroneously connected to the connection port for the indoor unit Yd of the outdoor unit control means 14.

Therefore, the outdoor unit control means 14 interchanges the recognition of wiring in accordance with the above-mentioned results (S15). That is, the outdoor unit control means 14 associates the individual wires 18 connected to the indoor unit control means 15 with the individual refrigerant circuits controlled by the outdoor unit control means 14, and changes the recognition of wire connections. After the completion of interchanging the recognition, "1" is written to the improper wiring correction bit and the improper wiring detection completion bit for the operating indoor unit Yd in a volatile memory in the outdoor unit control means 14 (S16 and S17), and the abnormality detection control ends.

(Improper Wiring Case 2)

In the above-mentioned state (improper wiring case 1; FIG. 2), the case in which not only the indoor unit Ya, but also the indoor units Yb and Yc are activated, and the number of operating units is three will be described. When the indoor units Ya, Yb, and Yc are operated by the remote controls 13*a*, 13*b*, and 13*c*, respectively, to perform cooling operation, after the indoor unit activating operation (S1), the outdoor unit control means 14 opens the expansion valves 6*a*, 6*b*, and 6*d* at a certain opening degree since there are improper wire connections, completely closes the expansion valve 6*c*, and stores that the indoor units Ya, Yb, and Yd are operating indoor units.

Next, whether a certain period of time has elapsed is determined (S2). When a certain period of time has elapsed, it is checked whether improper wiring detection control has been previously performed for each operating indoor unit Y (S3). When "1" is not detected in the improper wiring detection completion bit, abnormality determination of the indoor units Ya, Yb, and Yd, recognized by the outdoor unit control means 14 to be in an operating state, is performed (S4). Since the wire 18*a* is connected to the wire connection port for the indoor unit Yd of the outdoor unit control means 14, the indoor inlet air temperature T16*a* of the indoor unit Ya and the pipe temperature T17*a* of the indoor heat exchanger 7*a*, which are detected in step S4-1, are transmitted to the outdoor unit control means 14 (S4-2), and the temperature difference ΔTd is calculated from these two pieces of temperature data. Similarly, the temperature differences ΔTa and ΔTb are calculated for the indoor units Ya and Yb. Here, the temperature differences ΔT are respectively calculated in accordance with ΔTa=T16*b*-T17*b*, ΔTb=T16*c*-T17*c*, and ΔTd=T16*a*-T17*a*.

At this time, although the indoor unit Yb connected to the connection port for the indoor unit Ya of the outdoor unit control means 14 is in an improper wiring state, the expansion valve 6*b* communicated with the indoor heat exchanger 7*b* is open at a certain opening degree, The refrigerant flows into the indoor heat exchanger 7*b* to which air is sent by the indoor fan 8*b*, and the refrigerant is heat-exchanged and evaporated. The pipe temperature T17*b* of the indoor heat exchanger 7*b* is reduced to be less than the indoor inlet air temperature T16*b* by a certain temperature or greater, and the temperature difference ΔTa becomes greater than the certain value α1. Thus, the indoor unit Ya is determined to be normal in step S4-4.

Similarly, although the indoor unit Ya connected to the connection port for the indoor unit Yd of the outdoor unit control means 14 is in an improper wiring state, the expansion valve 6*a* communicated with the indoor heat exchanger 7*a* is open at a certain opening degree. The refrigerant flows into the indoor heat exchanger 7*a* to which air is sent by the indoor fan 8*a*, and the refrigerant is heat-exchanged and evaporated. The pipe temperature T17*a* of the indoor heat exchanger 7*a* is reduced to be less than the indoor inlet air temperature T16*a* by a certain temperature or greater, and the temperature difference ΔTd becomes greater than the certain value α1. Thus, the indoor unit Yd is determined to be normal in step S4-4.

However, with regard to the indoor unit Yc connected to the connection port for the indoor unit Yb of the outdoor unit control means 14, since the expansion valve 6*c* communicated with the indoor heat exchanger 7*c* to which air is sent by the indoor fan 8*c* is completely closed, no refrigerant flows into the indoor heat exchanger 7*c*. Thus, the refrigerant retained in the indoor heat exchanger 7*c* is quickly evaporated, and the pipe temperature T17*c* of the indoor heat exchanger 7*c* becomes substantially equal to the indoor inlet air temperature T16*c*. Thus, the temperature difference ΔTb becomes a value less than the certain value α1, and the indoor unit Yb is determined to be abnormal in step S4-4. At this time, the outdoor unit control means 14 stores that the indoor unit Yb is an abnormally operating indoor unit.

Next, in accordance with step S6, the outdoor unit control means 14 extracts deactivated indoor units Y, namely, the indoor unit Yc, and the number of deactivated units (p=1). The outdoor unit control means 14 performs abnormality determination of the deactivated indoor unit Yc.

Here, since the wire 18*d* is connected, due to an improper wire connection, to the connection port for the indoor unit Yc of the outdoor unit control means 14, the indoor inlet air temperature T16*d* of the indoor unit Yd and the pipe temperature T17*d* of the indoor heat exchanger 7*d* are transmitted to the outdoor unit control means 14, and the temperature difference ΔTc is calculated from these two pieces of temperature data. The expansion valve 6*d* communicated with the indoor heat exchanger 7*d* is open at a certain opening degree, and the temperature of the refrigerant flowing through the indoor heat exchanger 7*d* is greatly reduced. Thus, the temperature difference ΔTc becomes a value greater than the certain value β1, and it is determined that the operation is abnormal in step S6-5. The indoor unit Yc is stored as an abnormal indoor unit.

Next, the outdoor unit control means 14 determines whether there is one or more abnormal deactivated indoor units (S7). When there is one or more abnormal deactivated indoor units, the outdoor unit control means 14 performs expansion valve operation pattern extraction (S8). In accordance with each of the expansion valve operation patterns extracted in step S8, the outdoor unit control means 14 interchanges the operation of the expansion valves 6*a* to 6*d* (S9). After a certain period of time has elapsed (S10), the outdoor unit control means 14 determines whether the number of operating units changes (S11). When there is no change, the outdoor unit control means 14 performs abnormality re-determination of all the indoor units (S12).

It is determined whether the temperature difference ΔTa of the indoor unit Ya, the temperature difference ΔTb of the indoor unit Yb, and the temperature difference ΔTd of the indoor unit Yd, which are recognized by the outdoor unit control means 14 to be operating, are greater than the certain value α1, and whether the temperature difference ΔTc of the indoor unit Yc, which is recognized by the outdoor unit control means 14 to be deactivated, is less than the certain value β1.

Here, with regard to the operating indoor units Ya, Yb, and Yd, since there are indoor units that are determined to be abnormal with the expansion valves 6*a*, 6*b*, and 6*d*, in accordance with step S8, expansion valves to be opened at a certain opening degree are changed to the expansion valves 6*b*, 6*c*, and 6*a*. Accordingly, the refrigerant flows into the indoor units Yb, Yc, and Ya. At this time, the temperature difference ΔTa of the operating indoor unit Ya is calculated using the indoor inlet air temperature T16*b* of the indoor unit Yb and the pipe temperature T17*b* of the indoor heat exchanger 7*b* in accordance with ΔTa=T16*b*-T17*b*. Accordingly, the temperature difference ΔTa becomes a value greater than the certain value α1, and the condition is satisfied. Similarly, the temperature difference ΔTb=T16*c*-T17*c* is calculated for the indoor unit Yb, and the temperature difference ΔTd=T16*a*-T17*a* is calculated for the indoor unit Yd. Since these temperature differences become values greater than the certain value α1, the condition is satisfied. The outdoor unit control means 14 stores that the operating indoor units Ya, Yb, and Yd normally correspond to the expansion valves 6*b*, 6*c*, and 6*a*. Also, the temperature difference ΔTc of the deactivated indoor unit Yc is calculated in accordance with ΔTc=T16*d*-T17*d*. Here, ΔTc becomes a value less than the certain value β1, and the condition is satisfied. These results indicate that it is highly likely that an indoor unit connected to the wire connection port for the indoor unit Yc of the outdoor unit control means 14 and the expansion valve 6*d* for controlling a refrigerant circuit that corresponds to the aforementioned indoor unit constitute a normal combination. Thus, the outdoor unit control means 14 stores that the deactivated indoor unit Yc normally corresponds to the expansion valve 6*d*.

Then, expansion valves to be opened at a certain opening degree are changed to the expansion valves 6*b*, 6*c*, and 6*d*. Accordingly, the refrigerant flows into the indoor units Yb, Yc, and Yd. At this time, the temperature differences ΔTa and ΔTb of the operating indoor units Ya and Yb become values greater than the certain value α1, and the condition is satisfied. However, the temperature difference ΔTd of the operating indoor unit Yd becomes a value less than the certain value α1 and the condition is not satisfied. The outdoor unit control means 14 stores that the operating indoor units Ya and Yb normally correspond to the expansion valves 6*b*, 6*e*, and 6*d*, and the operating indoor unit Yd abnormally corresponds to the expansion valves 6*b*, 6*c*, and 6*d*. Also, the temperature difference ΔTc of the deactivated indoor unit Yc is calculated in accordance with ΔTc=T16*d*-T17*d*. Here, ΔTc becomes a value greater than the certain value β1, and the condition is not satisfied. These results indicate that it is highly likely that an indoor unit connected to the wire connection port for the indoor unit Yc of the outdoor unit control means 14 and one of the expansion valves 6*b*, 6*c*, and 6*d* for controlling a refrigerant circuit that corresponds to the aforementioned indoor unit constitute a normal combination. Thus, the outdoor unit control means 14 stores that the deactivated indoor unit Yc normally corresponds to the expansion valves 6*b*, 6*c*, and 6*d*.

Further, expansion valves to be opened at a certain opening degree are changed to the expansion valves 6*c*, 6*d*, and 6*a*. Accordingly, the refrigerant flows into the indoor units Yc, Yd, and Ya. At this time, the temperature differences ΔTb and ΔTd of the operating indoor units Yb and Yd become values greater than the certain value α1, and the condition is satisfied. However, the temperature difference ΔTa of the operating indoor unit Ya becomes a value less than the certain value α1, and the condition is not satisfied. The outdoor unit control means 14 stores that the operating indoor units Yb and Yd normally correspond to the expansion valves 6*c*, 6*d*, and 6*a*, and the operating indoor unit Ya abnormally corresponds to the expansion valves 6*c*, 6*d*, and 6*a*. Also, the temperature difference ΔTc of the deactivated indoor unit Yc is calculated in accordance with ΔTc=T16*d*-T17*d*. Here, ΔTc becomes a value greater than the certain value β1, and the condition is not satisfied. These results indicate that it is highly likely that an indoor unit connected to the wire connection port for the indoor unit Yc of the outdoor unit control means 14 and one of the expansion valves 6*c*, 6*d*, and 6*a* for controlling a refrigerant circuit that corresponds to the aforementioned indoor unit constitute a normal combination. Thus, the outdoor unit control means 14 stores that the deactivated indoor unit Yc normally corresponds to the expansion valves 6*c*, 6*d*, and 6*a*.

These results described above are summarized as follows. That is, an expansion valve that exists in all the combinations of expansion valves determined to normally correspond to the operating indoor unit Ya is the expansion valve 6*b*; an expansion valve that exists in all the combinations of expansion valves determined to normally correspond to the operating indoor unit Yb is the expansion valve 6*c*; an expansion valve that exists for all the combinations of expansion valves determined to normally correspond to the operating indoor unit Yd is the expansion valve 6*a*; and an expansion valve determined to normally correspond to the deactivated indoor unit Yc is the expansion valve 6*d*.

From the above description, it is understood that the deactivated indoor unit Yc matches the expansion valve 6*d* for controlling a refrigerant circuit that corresponds to the deactivated indoor unit Yc, and, at the same time, it is understood that the operating indoor unit Ya matches the expansion valve 6*b* for controlling a refrigerant circuit that corresponds to the operating indoor unit Ya; the operating indoor unit Yb matches the expansion valve 6*c* for controlling a refrigerant circuit that corresponds to the operating indoor unit Yb; and the operating indoor unit Yd matches the expansion valve 6*a* for controlling a refrigerant circuit that corresponds to the operating indoor unit Yd. In short, it is understood that the indoor unit Yb is erroneously connected to the connection port for the indoor unit Ya of the outdoor unit control means 14, the indoor unit Yc is erroneously connected to the connection port for the indoor unit Yb of the outdoor unit control means 14, the indoor unit Yd is erroneously connected to the connection port for the indoor unit Yc of the outdoor unit control means 14, and the indoor unit Ya is erroneously connected to the connection port for the indoor unit Yd of the outdoor unit control means 14.

Therefore, the outdoor unit control means 14 interchanges the recognition of wiring in accordance with the above-mentioned results (S15). After the completion of interchanging the recognition, "1" is written to the improper wiring correction bit and the improper wiring detection completion bit for the operating indoor units Ya, Yb, and Yd in a volatile memory in the outdoor unit control means 14, and the abnormality detection control ends.

Although the activation of an indoor unit serves as the timing to start abnormality detection control in Embodiment 1, needless to say, abnormality detection control may be started during normal operation. Although the multi-air-conditioning apparatus including four connected units has been discussed by way of example, needless to say, detection and correction of improper wiring can be performed regardless of the number of connection ports. Further, there is no problem when the number of operating indoor units changes during abnormality detection control. Also, needless to say, abnormality detection control may be performed in heating operation.

Although the case in which the refrigerant circuits of the indoor units Y in which the refrigerant is circulated are switched by the expansion valves 6 has been described in Embodiment 1, Embodiment 1 is not limited to this case. For example, opening/closing valves for opening and closing refrigerant passages to the individual indoor units Y may be provided, and a refrigerant circuit in which the refrigerant is circulated and a refrigerant circuit in which no refrigerant is circulated are switched by opening and closing the opening/closing valves in accordance with operation patterns.

In Embodiment 1 as described above, the indoor unit control means 15 transmits an operation command for a corresponding indoor unit Y to the outdoor unit control means 14. The outdoor unit control means 14 controls the refrigerant circulation of the refrigerant circuit of an indoor unit Y corresponding to a wire 18 that has received the operation command. When the received operation command for the indoor unit Y does not match the refrigerant circuit of the indoor unit Y whose refrigerant circulation is controlled, the association between each wire 18 to which the outdoor unit control means 14 and the indoor unit control means 15 are connected and the refrigerant circuit of each indoor unit Y whose refrigerant circulation is controlled is changed, thereby causing the received operation command for the indoor unit Y to match the refrigerant circuit of the indoor unit Y whose refrigerant circulation is controlled. Accordingly, improper wire connections can be eliminated without changing the wire connection.

On the basis of the number of operating indoor units Y, operation patterns of a refrigerant circuit in which a refrigerant is circulated and a refrigerant circuit in which no refrigerant is circulated are extracted. In accordance with each of the operation patterns, the refrigerant circuit in which the refrigerant is circulated is switched. On the basis of measurement information at that time and the operation state of an indoor unit corresponding to a wire 18 that has received the measurement information, the association between each wire 18 to which the outdoor unit control means 14 and the indoor unit control means 15 are connected and the refrigerant circuit of each indoor unit whose refrigerant circulation is controlled is changed, thereby changing the recognition of wire connections so that the received operation command for the indoor unit Y matches the refrigerant circuit of the indoor unit Y whose refrigerant circulation is controlled. Therefore, when there are multiple improper connections, even if multiple indoor units Y are operating, the improper wire connections can be eliminated by performing diagnostic operation once, without changing the wire connections.

When multiple received operation commands for the indoor units Y do not correspond to multiple refrigerant circuits of the indoor units Y whose refrigerant circulation is controlled, the outdoor unit control means 14 changes the association between the individual wires 18 connected to the indoor unit control means 15 and the individual refrigerant circuits controlled by the outdoor unit control means 14, thereby eliminating an improper wire connection state even when there are multiple improper wire connections.

The outdoor unit control means 14 calculates the temperature difference ΔT between the indoor inlet air temperature T16 and the pipe temperature T17 of the indoor heat exchanger 7, and determines whether the indoor unit Y is abnormal on the basis of the calculated temperature difference ΔT and the received operation command for the indoor unit Y. When the indoor unit Y is determined to be abnormal, it is understood that the operation command for the indoor unit Y, received from the indoor unit control means 15, does not match the refrigerant circuit of the indoor unit Y whose refrigerant circulation is controlled by the outdoor unit control means 14. The outdoor unit control means 14 changes the association between each wire 18 connected to the indoor unit control means 15 of the indoor unit Y determined to be abnormal and each refrigerant circuit controlled by the outdoor unit control means 14, thereby detecting a combination of improper wire connections and correcting an improper wire connection state without performing a re-wiring work.

The outdoor unit control means 14 calculates the temperature difference ΔT between the indoor inlet air temperature T16 of an operating indoor unit Y and the pipe temperature T17 of a corresponding heat exchanger 7, and determines whether the operation is abnormal by comparing the calculated temperature difference ΔT with the certain value α. The outdoor unit control means 14 calculates the temperature difference ΔT between the indoor inlet air temperature T16 of a deactivated indoor unit Y and the pipe temperature T17 of a corresponding heat exchanger 7, and determines whether the operation is abnormal by comparing the calculated temperature difference ΔT with the certain value β. When there is at least one operating indoor unit Y determined to be abnormal and deactivated indoor unit Y determined to be abnormal, if improper wire connections have been made, the improper wire connections can be detected in any of cooling, heating, and dehumidifying operation by changing the expansion valves 6 to be operated, and an improper wire connection state can be eliminated without performing a re-wiring work.

When the outdoor unit control means 14 determines that multiple indoor units Y are abnormal, the outdoor unit control means 14 extracts operation patterns of the expansion valves 6 in accordance with the number of operating indoor units Y, changes the expansion valves 6 to be operated in accordance with each of the operation patterns, and, every time the expansion valves 6 to be operated are changed, calculates the temperature difference ΔT between the indoor inlet air temperature T16 of each indoor unit Y and the pipe temperature T17 of a corresponding heat exchanger 7. For each operating indoor unit Y, the outdoor unit control means 14 compares the calculated temperature difference ΔT with the certain value α and determines whether the condition is satisfied, thereby determining whether the operating indoor unit Y and an expansion valve for controlling a refrigerant circuit that corresponds to the operating indoor unit Y constitute a correct combination. For a deactivated indoor unit Y, the outdoor unit control means 14 compares the calculated temperature difference ΔT with the certain value β and determines whether the condition is satisfied, thereby determining whether the deactivated indoor unit Y and an expansion valve for controlling a refrigerant circuit that corresponds to the deactivated indoor unit Y constitute a correct combination. Even when there are multiple improper wire connections, the improper wire connections can be detected, and an improper wire connection state can be eliminated without performing a re-wiring work.

When the outdoor unit control means 14 determines that an operating indoor unit Y is abnormal and at least one of multiple deactivated indoor units Y is abnormal, for the remaining deactivated indoor unit(s) Y that have been erroneously connected but are determined to be normally connected, the outdoor unit control means 14 extracts the operation patterns of the expansion valves 6 in accordance with the number of operating indoor units Y, changes the expansion valves 6 to be operated in accordance with each of the operation patterns, and, every time the expansion valves 6 to be operated are changed, calculates the temperature difference ΔT between the indoor inlet air temperature T16 of each indoor unit Y and the pipe temperature T17 of a corresponding heat exchanger 7. For each operating indoor unit Y, the outdoor unit control means 14 compares the calculated temperature difference ΔT with the certain value α and determines whether the condition is satisfied, thereby determining whether the operating indoor unit Y and an expansion valve for controlling a refrigerant circuit that corresponds to the operating indoor unit Y constitute a correct combination. For each deactivated indoor unit Y, the outdoor unit control means 14 compares the calculated temperature difference ΔT with the certain value β and determines whether the condition is satisfied, thereby determining whether the deactivated indoor unit Y and an expansion valve for controlling a refrigerant circuit that corresponds to the deactivated indoor unit Y constitute a correct combination. Accordingly, even the improper wiring state of the erroneously connected deactivated indoor unit(s) Y can be detected, and the improper wire connection state can be eliminated without performing a re-wiring work.

After detecting an abnormality in an operating indoor unit Y, or when no abnormality is detected in a deactivated indoor unit Y and after determination is performed for all the extracted operation patterns of the expansion valves 6, the outdoor unit control means 14 outputs an abnormality signal when no combination in which each indoor unit Y normally corresponds to an expansion valve 6 for controlling a refrigerant circuit that corresponds to that indoor unit Y is detected for all the indoor units Y, and an abnormality is still determined. Therefore, an abnormality different from detection of improper wiring can be detected. Accordingly, improper wire connections can be excluded from candidate causes of the abnormality. This may reduce the burden on a person in charge of repairing the apparatus.

After a certain period of time has elapsed since the activation of an indoor unit Y, the outdoor unit control means 14 refers to the improper wiring detection history of the operating indoor unit Y, which is stored in a volatile memory of the outdoor unit control means 14. When improper wiring detection has already been performed, the outdoor unit control means 14 need not perform abnormality determination. This may reduce the time involved in detecting an improper wire connection or an abnormality.

The recognition of association between each refrigerant circuit and its wire connections is stored in a non-volatile memory of the outdoor unit control means 14, whereas whether improper wiring detection has been performed is stored in a volatile memory of the outdoor unit control means 14. Thus, the improper wiring detection bit returns to "0" in response to power-on reset. When it is necessary to relocate the multiple-unit air conditioning apparatus, if improper wire connections are made at the time of relocation, improper wiring detection is performed again. Therefore, the multiple-unit air conditioning apparatus is capable of handling an abnormality that may occur in relocation.

Also, the improper wiring detection bit returns to "0" in response to power-on reset after the power is restored after a blackout. Thus, even when detection and correction of improper wiring have been previously performed, improper wiring detection control is performed again. In the first abnormality determination of an operating indoor unit Y (S4), the indoor unit Y is determined to be normal. At that point, control is terminated, and normal operation is resumed, Since improper wiring detection can be performed even when the number of operating indoor units Y changes during this control, if no test operation is performed at the time of installation, an improper wire connection state can be detected while the user actually uses the multiple-unit air conditioning apparatus, and, in that state, the multiple-unit air conditioning apparatus can perform normal operation desired by the user without performing a re-wiring work.

REFERENCE SIGNS LIST

1 compressor, 2 four-way valve, 3 outdoor heat exchanger, 4 outdoor fan, 5 outdoor fan motor, 6 expansion valves (6*a* to 6*d*), 7 indoor heat exchangers (7*a* to 7*d*), 8 indoor fans (8*a* to 8*d*), 9 indoor fan motors (9*a* to 9*d*), 10 liquid pool, 11 liquid pipes (1l*a* to 11*d*), 12 gas pipes (12*a* to 12*d*), 13 remote controls (13*a* to 13d), 14 outdoor unit control means, 15 indoor unit control means (15*a* to 15*d*), 16 indoor inlet air temperature detecting means (16*a* to 16*d*), 17 indoor heat exchanger temperature detecting means (17*a* to 17*d*), 18 to 26 wires (18*a* to 26*d*), X outdoor unit, Y indoor units (Ya to Yd).

The invention claimed is:

1. A multiple-unit air conditioning apparatus comprising:

an outdoor unit; and a plurality of indoor units, wherein a compressor, indoor heat exchangers provided for the individual indoor units, expansion devices that are provided for the individual indoor heat exchangers and that change refrigerant flow rate, and an outdoor heat exchanger provided for the outdoor unit are connected by refrigerant pipes, and refrigerant circuits in which a refrigerant is circulated are formed for the individual indoor units, wherein each of the indoor units includes:

an indoor unit electronic controller configured to control operation of the indoor unit and transmit an operation command for the indoor unit and measurement information of the indoor unit, wherein the outdoor unit includes an outdoor unit electronic controller connected by wires to the indoor unit electronic controller of the individual indoor units, and wherein the outdoor unit electronic controller is configured to:

(a) receive an operation command for each of the indoor units, transmitted by the indoor unit electronic controller of the indoor unit, recognize that the indoor unit corresponding to the wire that has received the operation command is operating, and perform control to circulate the refrigerant in a refrigerant circuit corresponding to the operating indoor unit, (b) determined whether data, written in a volatile memory, indicates that recognition of wire connections is previously performed, when the data in the volatile memory is determined to indicate that the recognition of the wire connections is previously performed, cancel performance of steps (c) to (h) and proceed to normal operation, when the data in the volatile memory is determined to indicate that the recognition of the wire connections is not previously performed, perform the following:

(c)when the operation command for the indoor unit, received from the indoor unit electronic controller, does not match the refrigerant circuit of the indoor unit whose refrigerant circulation is controlled by the outdoor unit electronic controller, (d) extract operation patterns of a refrigerant circuit in which the refrigerant is circulated and a refrigerant circuit in which no refrigerant is circulated, on the basis of a number of operating indoor units, (e) switch the refrigerant circuit in which the refrigerant is circulated, in accordance with the operation patterns, (f) associate each wire connected to the indoor unit electronic controller of each indoor unit and each refrigerant circuit controlled by the outdoor unit electronic controller, on the basis of the measurement information of the indoor unit, received from the indoor unit electronic controller, and an operation state of the indoor unit corresponding to the wire which has received the measurement information, and (g) change recognition of the wire connections so that the operation command for the indoor unit, received from the indoor unit electronic controller, matches the refrigerant circuit of the indoor unit whose refrigerant circulation is controlled by the outdoor unit electronic controller, and (h) write data in a volatile memory, the data which is written indicates that the recognition of the wire connections is previously performed.

2. The multiple-unit air conditioning apparatus of claim 1, further comprising:

an inlet air temperature detector that detects a temperature of indoor air absorbed into each of the indoor units; and a heat exchanger temperature detector that detects a pipe temperature of each of the indoor heat exchangers, wherein the indoor unit electronic controller is further configured to:

transmit, as the measurement information, information of the inlet air temperature of the indoor unit, detected by the inlet air temperature detector, and information of the pipe temperature of the heat exchanger of the indoor unit, detected by the heat exchanger temperature detector, and wherein the outdoor unit electronic controller is further configured to:

calculate a temperature difference between the inlet air temperature and the pipe temperature of the heat exchanger, received from the indoor unit electronic controller, determine whether the indoor unit is abnormal, on the basis of the calculated temperature difference and the received operation command for the indoor unit, when at least one indoor unit is determined to be abnormal, regard that the operation command for the indoor unit, received from the indoor unit electronic controller, does not match the refrigerant circuit of the indoor unit whose refrigerant circuit is controlled by the outdoor unit electronic controller, and change association between a wire connected to the indoor unit electronic controller of the indoor unit determined to be abnormal and the refrigerant circuit controlled by the outdoor unit electronic controller.

3. The multiple-unit air conditioning apparatus of claim 2, wherein the outdoor unit electronic controller is further configured to:

determine, on the basis of whether the temperature difference between the inlet air temperature and the pipe temperature of the heat exchanger, received from the wire corresponding to the operating indoor unit, is within a first certain range, whether the indoor unit is abnormally operating, determine, on the basis of whether the temperature difference between the inlet air temperature and the pipe temperature of the heat exchanger, received from the wire corresponding to the deactivated indoor unit, is within a second certain range, whether the indoor unit is abnormally operating, and change association between a wire connected to the indoor unit electronic controller of the indoor unit determined to be abnormal and the refrigerant circuit controlled by the outdoor unit electronic controller.

4. The multiple-unit air conditioning apparatus of claim 2, wherein, after the outdoor unit electronic controller opens or closes each of the expansion devices in accordance with the operation patterns, and switches the refrigerant circuit in which the refrigerant is circulated, the outdoor unit electronic controller is further configured to:

determine, on the basis of whether the temperature difference between the inlet air temperature and the pipe temperature of the heat exchanger, received from the wire corresponding to an operating indoor unit, is within a first certain range, whether the indoor unit is abnormally operating, determine, on the basis of whether the temperature difference between the inlet air temperature and the pipe temperature of the heat exchanger, received from the wire corresponding to the deactivated indoor unit, is within a second certain range, whether the indoor unit is abnormally operating, and change association between the wire connected to the indoor unit electronic controller of the indoor unit determined to be abnormal and the refrigerant circuit controlled by the outdoor unit electronic controller.

5. The multiple-unit air conditioning apparatus of claim 2, wherein, when the outdoor unit electronic controller determines that multiple operating indoor units are abnormal, the outdoor unit electronic controller is further configured to:

extract operation patterns each including a combination of an open state or a closed state of each of the expansion devices, on the basis of the number of operating indoor units and the number of deactivated indoor units, open/close each expansion device in accordance with the operation patterns, for each of the operation patterns, determine, on the basis of whether the temperature difference between the inlet air temperature and the pipe temperature of the heat exchanger, received from the wire corresponding to the operating indoor unit, is within a first certain range, whether the indoor unit is abnormally operating, determine, on the basis of whether the temperature difference between the inlet air temperature and the pipe temperature of the heat exchanger, received from the wire corresponding to the deactivated indoor unit, is within a second certain range, whether the indoor unit is abnormally operating, and associate each wire connected to the indoor unit electronic controller of each indoor unit and each refrigerant circuit controlled by the outdoor unit electronic controller, and change recognition of the wire connections, on the basis of the open/closed state of each expansion device in the operation pattern in which all the indoor units operate normally, and an operation state of the indoor unit corresponding to each wire.

6. The multiple-unit air conditioning apparatus of claim 2, wherein the outdoor unit electronic controller is further configured to:

output an abnormality signal indicating that there is an abnormality different from improper wiring, when not all the indoor units operate normally in all the combinations of the operation patterns.

7. The multiple-unit air conditioning apparatus of claim 2, wherein the outdoor unit electronic controller is further configured to:

calculate the temperature difference between the inlet air temperature and the pipe temperature of the heat exchanger, received from the indoor unit electronic controller.

8. The multiple-unit air conditioning apparatus of claim 1, wherein the outdoor unit electronic controller is further configured to:

determine whether all the indoor units have an abnormality different from improper wiring based on whether all the indoor units operate normally in all the combinations of the operation patterns;

responsive to a determination that all the indoor units have the abnormality different from improper wiring, clear the data in the volatile memory to indicate that the recognition of the wire connections is not previously performed so that abnormality determination of the indoor units is performed; and responsive to a determination that all the indoor units do not have the abnormality different from improper wiring, indicate in the volatile memory that the recognition of the wire connections is previously performed and proceed to the normal operation.

9. The multiple-unit air conditioning apparatus of claim 1, wherein the outdoor unit electronic controller is further configured to when the data in the volatile memory is determined to indicate that the recognition of the wire connections is not previously performed pursuant to step (b) and when the operation command for the indoor unit, received from the indoor unit electronic controller, is determined to not match the refrigerant circuit of the indoor unit whose refrigerant circulation is controlled by the outdoor unit electronic controller pursuant to step (c), perform steps (d) to (g) for all of the plurality of indoor units recognized by the outdoor unit electronic controller to be in a deactivated state.

10. The multiple-unit air conditioning apparatus of claim 1, wherein the outdoor unit electronic controller is further configured to when step (f) is performed, perform step (f) for each wire of the wires that connect the outdoor unit electronic controller to each indoor unit of the plurality of indoor units which are recognized by the outdoor unit electronic controller, including (i) to indoor units recognized by the outdoor unit electronic controller as operating normally and (ii) to indoor units recognized by the outdoor unit electronic controller as operating abnormally.

* * * * *